US005402774A

United States Patent [19]

Tiballi

[11] Patent Number: 5,402,774

[45] Date of Patent: Apr. 4, 1995

[54] SNORKEL SAFETY DEVICE

[76] Inventor: Nancy Tiballi, 3789 Gold Point Dr., North Miami Beach, Fla. 33180

[21] Appl. No.: 144,825

[22] Filed: Nov. 1, 1993

[51] Int. Cl.[6] ..... B63C 11/16

[52] U.S. Cl. ..... 128/201.11; 128/201.27

[58] Field of Search ..... 128/200.25, 201.11, 128/201.27, 201.28, 204.26; 405/86; 417/61; 116/173, 28 R, 209; 40/212, 214, 590; 244/153 R, 155 R; 441/89

[56] References Cited

U.S. PATENT DOCUMENTS

| | | | |
|---|---|---|---|
| 156,599 | 11/1874 | Schmitz | 128/201.11 |
| 183,521 | 10/1876 | Weck | 128/202.15 |
| 3,104,644 | 9/1963 | Burton | 116/209 |
| 3,751,030 | 8/1973 | Winters | 429/129 |
| 3,872,529 | 3/1975 | Wainwright | 116/173 X |
| 4,035,856 | 7/1977 | Oberg | 9/313 |
| 4,245,632 | 1/1981 | Houston | 128/205.13 |
| 4,598,661 | 7/1986 | Roe | 116/209 |
| 4,599,965 | 7/1986 | Johnson | 116/209 |
| 4,674,493 | 6/1987 | Mitchell | 128/202.14 |
| 4,768,690 | 9/1988 | Stoutenburg | 224/273 |
| 4,796,553 | 1/1989 | Cogswell et al. | 116/173 |
| 4,832,013 | 5/1989 | Hartdorn | 128/202.19 |
| 4,876,981 | 10/1989 | Barnhart | 116/173 |
| 4,896,664 | 1/1990 | Harayama | 128/200.25 |
| 5,092,556 | 3/1992 | Darling et al. | 248/519 |

FOREIGN PATENT DOCUMENTS

| | | | |
|---|---|---|---|
| 594198 | 5/1959 | Italy | 128/201.11 |

*Primary Examiner*—Edgar S. Burr
*Assistant Examiner*—William J. Deane, Jr.
*Attorney, Agent, or Firm*—Malloy & Malloy

[57] ABSTRACT

A snorkel safety device to be utilized by a diver so as to identify their precise location within the water, the safety snorkel including a snorkel tube having a proximal end and a distal end adapted to protrude through a water surface during use for breathing, and including a substantially thin, lightweight rod secured to the distal end of the snorkel tube and extending therefrom so as to protrude above the water surface when the snorkel tube is being used for breathing, the rod including a flag secured to which will be substantially visible above the water surface and identify the diver and the diver's location.

8 Claims, 1 Drawing Sheet

SNORKEL SAFETY DEVICE

BACKGROUND OF THE INVENTION

1. Field of the Invention

The present invention relates to a snorkel safety device adapted to make an individual swimming along the water's surface visible and identifiable to others in the area.

2. Description of the Related Art

Snorkeling, wherein individuals swim along the surface of the water utilizing a snorkel tube to breath without having to remove their face from beneath the surface of the water is an increasingly popular activity for adults and children. Generally, when individuals snorkel, either as part of a dive group or on their own, dive buoys with diver down flags are set up in the vicinity of the dive area. Unfortunately, however, unless many dive buoys are utilized, it is difficult to define the precise dive area, and with active snorkelers, they may swim some distance from the dive buoy while exploring beneath the water's surface. The diver down flags are utilized because in addition to being a very entertaining activity, snorkeling can also become a very dangerous activity. Particularly, when snorkeling, very little of the diver protrudes through the water's surface and the snorkel tube itself which protrudes through the water's surface is difficult to identify. Accordingly, it would be highly beneficial to provide a safety device which enables a snorkeler to be easily located from above the water's surface yet will not be overly restrictive so as to make snorkeling difficult or cumbersome and thereby making the device unpleasant to utilize.

Some devices, such as those disclosed in the patents to Schmitz, U.S. Pat. No. 156,599, Weck, U.S. Pat. No. 183,521, and Mitchell, U.S. Pat. No. 4,674,493 have secured a signal flag to an underwater breathing apparatus. These devices, however, are adapted to enable the swimmer to swim some distance from the location of air intake. While enabling a diver to go deeper and still be able to breath, these devices also enable an individual to roam far from the location of the dive flag thereby minimizing the safety advantages of the warning flag since it is not at the exact point at which the diver is swimming. Further, such devices could be difficult to utilize for large group dives wherein many individuals are in the water and the air intakes can easily become tangled. Also, they would require that many individuals who already have a snorkel tube get all new dive equipment. Most importantly, the safety device should be utilized at all times and should pinpoint the location of the snorkeler rather than the general location of the snorkel as is the case with dive buoys; or signal devices which are allowed to float freely away from the snorkeler's body. Additionally, if the signal device is allowed to float freely away from the user's body, entanglement of the diver or other divers, with the safety device may become problematic.

In addition to warning others of the presence of a snorkeler, it would also be highly beneficial to be able to identify a particular snorkeler from a boat, dock, or beach. In the case of large dive boats from which many snorkelers leave at one time, and in the case of small children, it would be beneficial for a captain or guardian to be able to identify which particular snorkelers are associated with them so that a proper lookout for emergency situations can be maintained. If the safety device were allowed to roam free or far from the snorkeler's body, it would be difficult to identify particular snorkeler's especially in popular dive locations where there are many snorkeler's swimming at one time.

The device of the present invention is adapted to enable easy and comfortable adaptation and use with existing dive equipment and enables precise identification and signalling of a snorkeler's location to be maintained, thereby overcoming the precisely recited difficulties associated with known safety systems.

SUMMARY OF THE INVENTION

The present invention is directed towards a snorkel safety device to be utilized by a snorkeler to provide identification and a warning of their presence to others. The safety device includes primarily a snorkel tube with the distal end and a proximal end. The proximal end is to be contained with the snorkeler's mouth and the distal end is positioned to extend behind the user's head so that during use, the distal end will extend through the water's surface and allow the snorkeler to breath through the tube. Further included is a substantially thin, lightweight rod. The rod, which includes a first end and a second end is adapted to be secured, at its second end, at the distal end of the snorkel tube. The rod is secured in such a manner that the first end of the rod will extend away from and beyond the distal end of the snorkel tube thereby extending above the water's surface during use of the snorkel tube. Secured to the rod at the first end is a flag. The flag is positioned so as to be visible above the water's surface at all times that the snorkel tube is being used for breathing, thereby identifying and locating the snorkeler within the water.

The object of the present invention is to provide a snorkel safety device which will ensure that the precise location of a snorkeler is visible at all times when they are swimming along the surface of the water.

Still another object of the present invention is to provide a snorkel safety device which will enable an individual snorkeler to be identifiable to others.

Yet another object of the present invention is to provide a snorkel safety device which is easy to utilize, is noncumbersome, will not interfere with normal snorkeling activities, and can be adapted for use with existing snorkel tubes and systems.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
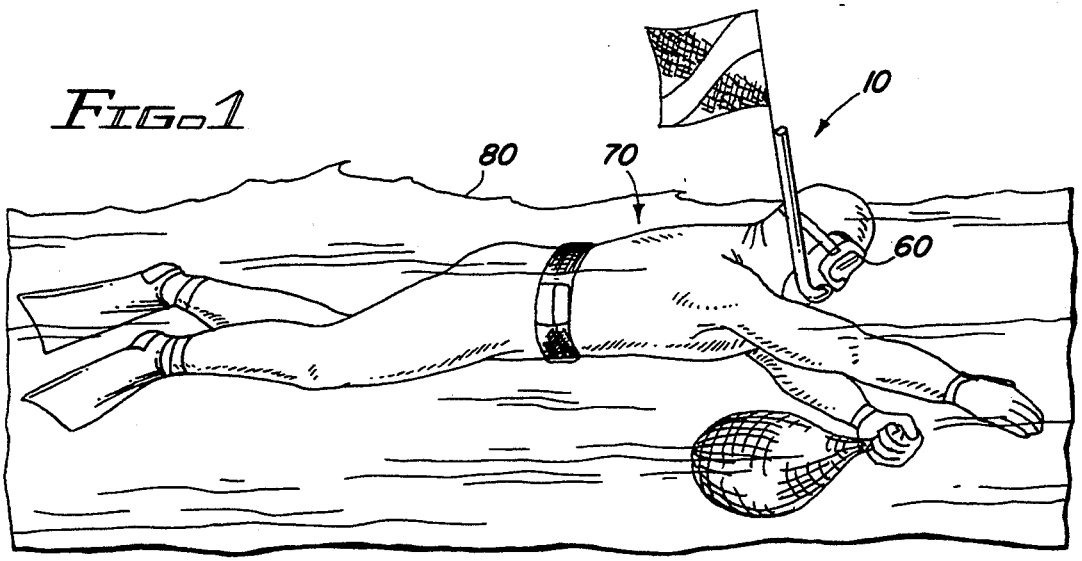
FIG. 1 is a perspective view of the snorkel safety device in use by a snorkeler.

As shown throughout FIGS. 1–4, the present invention is directed towards a snorkel safety device generally indicated as 10. The snorkel safety device 10 is adapted to be used by a snorkeler/diver 70 so as to identify their exact location and to identify them to others. The snorkel safety device 10 includes primarily a snorkel tube 20 having a distal end 22 and a proximal end 24. Disposed at the proximal end 24 is a mouth piece 25 which is adapted to be easily and conveniently fitted within the mouth of a diver 70, thereby enabling the diver 70 to hold the snorkel tube 20 utilizing their mouth. The distal end 22 of the snorkel tube 20 is structured to extend behind the user's head during use so as to protrude through the surface of the water 80. Through an opening 26 at the distal end 22 of the snorkel tube 20, air is drawn into the hollow interior of the snorkel tube 20 and provided to the diver 70 through the mouthpiece 25 such that the diver 70 may breathe while maintaining their face underwater. Secured to the snorkel tube 20 is a substantially thin, lightweight rod 30. The lightweight rod 30 has a first end 36 and a second end 32, and is adapted to be secured at the distal end 22 of the snorkel tube 20. The rod 30 is secured at its second end 232 to the distal end 22 of the snorkel tube 20 such that the first end 36 of the rod 30 extends beyond the distal end 22 of the snorkel tube 20 and above the water surface 80 during use. The rod 40 is structured to be sufficiently rigid so as to remain substantially upright during swimming, thereby maximizing the amount of the rod 30 which is visible above the water's surface 80. Secured to the rod 30 at its first end 36 is a flag 40. The flag 40 is preferably a diver down flag of the type universally known to indicate the presence of a diver. The flag 40 is fixedly secured at the first end 36 of the rod 30 so as to not fall off during use, and will preferably be adapted with an identification marker 42. The identification marker 42 is structured to be highly visible such that an onlooker such as a dive captain or parent can easily identify a particular diver in the water. By placing the flag 40 at the uppermost first end 36 of the rod 30, the presence of the diver 70 will be highly visible when the snorkel tube 20 is being utilized for breathing.

Figure 2:
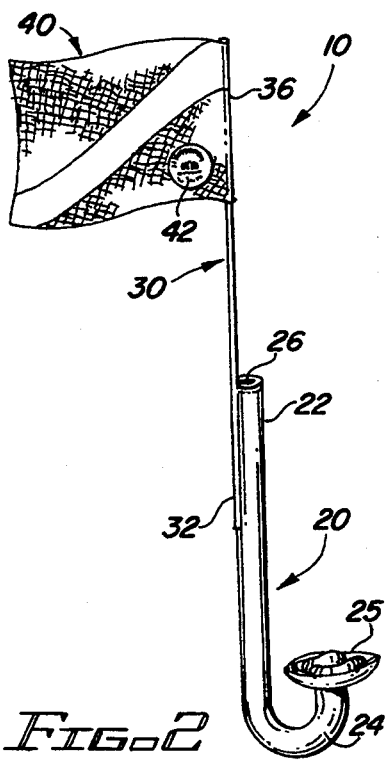
FIG. 2 is a side view of a first embodiment of the snorkel safety device.

Turning to FIG. 2, in a first embodiment of the snorkel safety device 10, the rod 30 is fixedly secured to the distal end 22 of the snorkel tube 20. The rod 30 may be integrally formed directly in the material of the snorkel tube 20, may be adhesively secured within an opening in the material walls of the snorkel tube 20, or may be fixedly attached by a material layer disposed about the second end 32 of the rod and the distal end 22 of the snorkel tube 20 so as to bond the two together. When fixedly secured, a diver can be assured that the rod 30 will remain attached even when diving beneath the surface. Further, parents and others can be assured that the rod 30 and flag 40 will always be utilized with the snorkel tube 20.

Figure 3:
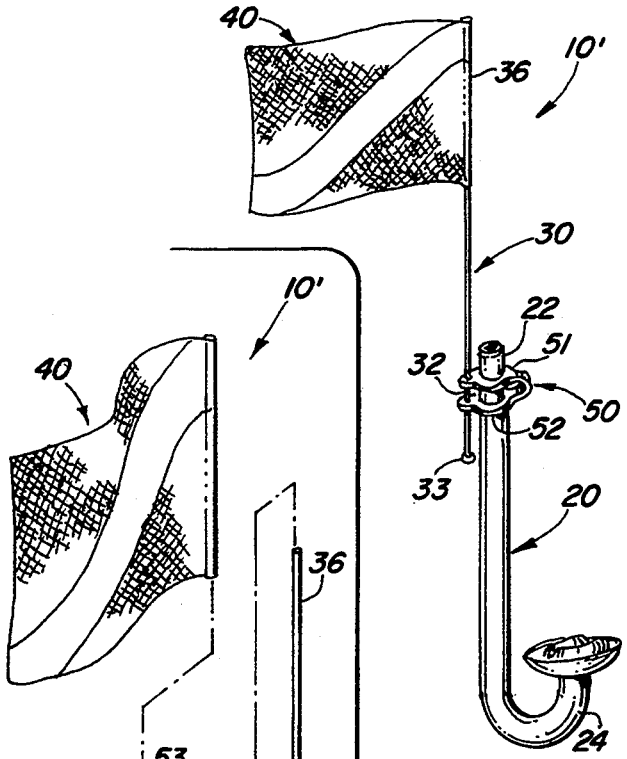
FIG. 3 is a side view of a second embodiment of the snorkel safety device.
Figure 4:
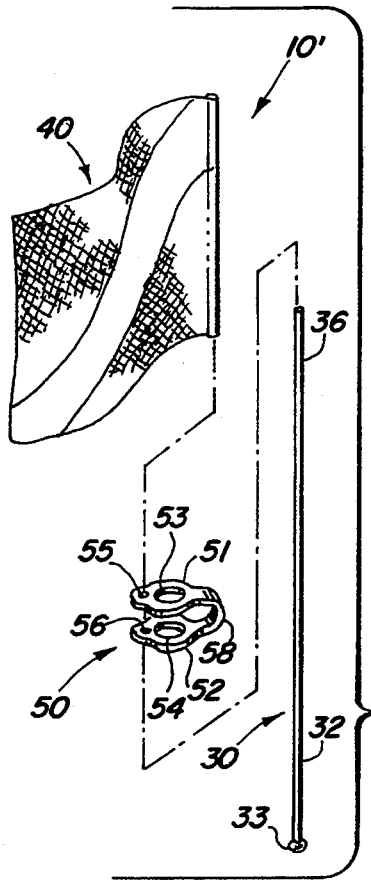
FIG. 4 is an exploded view of the second embodiment of the snorkel safety device.

As illustrated in FIGS. 3 and 4, a second embodiment of the snorkel safety device 10' is adapted to enable the rod 30 to be adjustably secured to the snorkel tube 20. Particularly, the rod 30 and flag 40 may be included as part of a single adjustable assembly with the snorkel tube 20, or may be provided separately so as to adapt a diver's own snorkel tube 20 to function as a snorkel safety device 10'. In this embodiment, the rod 30 is secured to the snorkel tube 20 utilizing an elastic band 50. The elastic band. 50 preferably includes a pair of elastic loop segments 51 and 52, each containing an opening 53 and 54 disposed therein. The openings 53 and 54 are sized to snugly receive the distal end 22 of the snorkel tube 20 therethrough, and accordingly tightly secure the elastic band 50 to the snorkel tube 20. Connecting the loop segments 51 and 52 is a connector segment 58. The connector segment 58 is included to provide added stability of the grip of the elastic band 50 to the snorkel tube 20 and also functions to enable the diver 70 to secure the elastic band 50 to the diver's mask 60 in addition to the snorkel tube 20. By securing the elastic band 50 to the diver's mask 60, the diver 70 is assured that the snorkel tube 20 will always remain in place even if the mouthpiece 25 is released by the diver 70. Further, appropriate orientation of the snorkel tube 20 such that the distal segment 22, and as a result, the rod 30 and flag 40 extend above the surface of the water 80, will be maintained if the elastic band 50 is secured to the mask 60. Disposed within each of the loop segments 51 and 52 are two small apertures 55 and 56. These small apertures 55 and 56 are adapted to receive the second end 32 of the rod 30 therethrough. The apertures 55 and 56 are sized to securely hold the rod 30 therein and prevent slippage and/or sliding of the rod 30 therethrough, thereby assuring that proper orientation of the rod 30 and flag 40 is maintained and assuring that the second end 32 does not slide, too far towards a proximal end 24 of the snorkel tube 20 where it may obstruct the diver 70. As a further convenience, a stopper cover 33 is included on the second end 32 of the rod 30, the stopper cover 33 functioning both to maintain the rod 30 within the apertures 55 and 56 and to protect the diver 70 from being poked by the second end 32 of the rod 30.

The rod 30 is structured to be sturdy yet slightly flexible. In particular, the rod is adapted to enable a diver to dive down below the surface of the water 80 without excessive added resistance, and is formed so as to maintain a proper orientation above the water's surface when the diver 70 reaches the water's surface 80.

Now that the invention has been described,

What is claimed is:

1. A snorkel safety device comprising:

a short, resilient head mounted snorkel tube including a distal end and a proximal end, said proximal end being structured and disposed to be maintained in a user's mouth and said distal end being structured and disposed to extend behind the user's head during use so as to protrude through a water's surface and facilitate breathing of air drawn into said tube through said distal end only when the user is swimming at the water's surface, a thin, lightweight rod, said rod including a first end and a second end, said second end being secured to said distal end of said snorkel tube such that said first end of said rod extends beyond said distal end of said snorkel tube and above the water's surface, and a flag secured to said rod at said first end thereof, said flag being disposed to be visible above the water's surface to indicate the exact location of the user when the snorkel tube is being used for breathing with said distal end protruding through the water's surface.

2. A snorkel safety device as recited in claim 1 wherein said second end of said rod is fixedly secured to said snorkel tube at said distal end.

3. A snorkel safety device as recited in claim 1 further including an elastic band structured and disposed to be removably and adjustably positioned about said snorkel tube at said distal end, said elastic band being further structured and disposed to receive said second end of said rod therein so as to secure said rod to said snorkel tube.

4. A snorkel safety device as recited in claim 3 wherein said second end of said rod includes a protective stopper cover.

5. A snorkel safety device as recited in claim 4 wherein said flag includes an identification marker visibly disposed thereon.

6. In combination, a substantially short, resilient head mounted snorkel having a proximal end to be placed in a user's mouth and a distal end to protrude through a water surface for breathing and a snorkel safety device, said snorkel safety device comprising:

a thin, lightweight rod, said rod including a first end and a second end, a flag secured to said rod at said first end thereof, fastening means structured and disposed to secure said second end of said rod to the distal end of the snorkel tube such that said first end of said rod extends beyond the distal end of the snorkel tube and above the water's surface to indicate the exact location of the user when the user is swimming at the water's surface.

7. A snorkel safety device as recited in claim 6 wherein said fastening means includes an elastic band structured and disposed to be removably and adjustably positioned about the distal end of the snorkel and to receive said second end of said therein, thereby securing said rod to the snorkel.

8. A snorkel safety device as recited in claim 7 wherein said flag includes an identification marker visibly disposed thereon.

* * * * *